US005788477A

United States Patent [19]

Jones

[11] Patent Number: 5,788,477

[45] Date of Patent: Aug. 4, 1998

[54] GAS FLARE

[76] Inventor: Wendyle Jones, R.R. 2, Sundre, Alberta, Canada, T0M 1X0

[21] Appl. No.: 813,235

[22] Filed: Mar. 26, 1997

[51] Int. Cl.[6] ..... F23Q 9/00

[52] U.S. Cl. ..... 431/202; 431/5; 431/285

[58] Field of Search ..... 431/285, 5, 202, 431/284

[56] References Cited

U.S. PATENT DOCUMENTS

| | | | |
|---|---|---|---|
| 3,658,482 | 4/1972 | Evans et al. . | |
| 3,822,985 | 7/1974 | Straitz, III | 431/202 |
| 3,850,581 | 11/1974 | Hills et al. | 431/202 |
| 3,985,494 | 10/1976 | Childree | 431/202 |
| 4,243,376 | 1/1981 | Cambell et al. . | |
| 4,255,120 | 3/1981 | Straitz, III . | |
| 4,269,583 | 5/1981 | Straitz, III . | |
| 4,516,932 | 5/1985 | Chaudet . | |
| 4,799,878 | 1/1989 | Schaeffer . | |
| 4,802,423 | 2/1989 | Pennington . | |
| 4,975,042 | 12/1990 | Schwartz et al. . | |
| 5,253,596 | 10/1993 | Bono Coraggioso . | |
| 5,380,195 | 1/1995 | Reid et al. . | |
| 5,498,153 | 3/1996 | Jones . | |
| 5,562,438 | 10/1996 | Gordon et al. | 431/5 |

*Primary Examiner*—Carl D. Price

*Attorney, Agent, or Firm*—Davis and Bujold

[57] ABSTRACT

A gas flare includes a primary combustion air passage having an inlet end, an outlet end and an interior cavity that extends between the inlet end and the outlet end. A pressurized gas injection ring encircles the outlet end of the primary air passage. The pressurized gas injection ring has a plurality of nozzles. Each of the nozzles is angled inwardly, upwardly and a few degrees laterally. This creates a venturi effect with a generally helical circulation that draws combustion air from the primary combustion air passage and intermixes the gas with the combustion air to form a combustible mixture.

3 Claims, 3 Drawing Sheets

GAS FLARE

FIELD OF THE INVENTION

The present invention relates to a gas flare and, in particular, a gas flare for flaring "dry" gas for which liquid knockout is not required.

BACKGROUND OF THE INVENTION

U.S. Pat. No. 5,498,153 which issued to Wendyle Jones in 1996 describes a gas flare for "wet" gas. "Wet" gas is laden with liquids which must be removed prior to flaring. The configuration described in the Jones '153 patent includes a vent stack for combustion air that has a cyclone chamber surrounding it. The cyclone chamber is used to remove liquids from the "wet" gas prior to combustion. A gaseous fuel injection ring surrounds the vent stack feeding gaseous fuel under pressure into the cyclone chamber. The gaseous fuel flowing under pressure creates a venturi effect, drawing combustion air from the vent stack to form an air/fuel mixture that is ignited by an igniter.

The liquid knockout intended for "wet" gas applications is redundant in "dry" gas applications. However, when Jones attempted to convert the structure of the '153 patent to suit "dry" gas applications, the air and the gas tended to flow straight up the vent stack without adequate intermixing occurring.

SUMMARY OF THE INVENTION

What is required is a configuration of gas flare better suited for use in flaring "dry" gas.

According to the present invention there is provided a gas flare which includes a primary combustion air passage having an inlet end, an outlet end and an interior cavity that extends between the inlet end and the outlet end. A pressurized gas injection ring encircles the outlet end of the primary air passage. The pressurized gas injection ring has a plurality of nozzles. Each of the nozzles is angled inwardly, upwardly and laterally in a substantially consistent fashion. This creates a venturi effect with a generally helical circulation that draws combustion air from the primary combustion air passage and intermixes the gas with the combustion air to form a combustible mixture. Means is provided for igniting the combustible mixture.

The gas flare, as described above, works to intermix the flare gas with combustion air as long as there is adequate pressure in the gas feed line. In field tests of the technology it was discovered that a pressurized gas feed was not always possible. Many gas well installations are sensitive to back-pressure.

Although beneficial results may be obtained through the use of the invention, as described above, even more beneficial results may, therefore, be obtained when a non-pressurized gas passage is concentrically positioned within the interior cavity of the primary air passage. The non-pressurized gas passage has an inlet end and an outlet end. The outlet end is positioned adjacent to the outlet end of the primary air passage. In such installations the non-pressurized gas which is to be flared is fed up through the concentrically disposed non-pressurized gas passage. Pressurized make up gas to create a venture draw and intermixing of the gas and combustion air is fed into the pressurized gas injection ring. There is usually some facility on site from which such pressurized make up gas can be obtained, such as a gas treater.

The gas flare burns more efficiently if the combustion air is preconditioned. Even more beneficial results may, therefore, be obtained when a heat exchanger is connected to the inlet end of the primary air passage, thereby preheating combustion air.

In order to achieve maximum burn efficiency there must be abundant combustion air. Even more beneficial results may, therefore, be obtained when a combustion air circulation ring encircles the outlet end of the primary combustion air passage. The ring has a plurality of secondary combustion air passages from which additional combustion air may be drawn as required.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
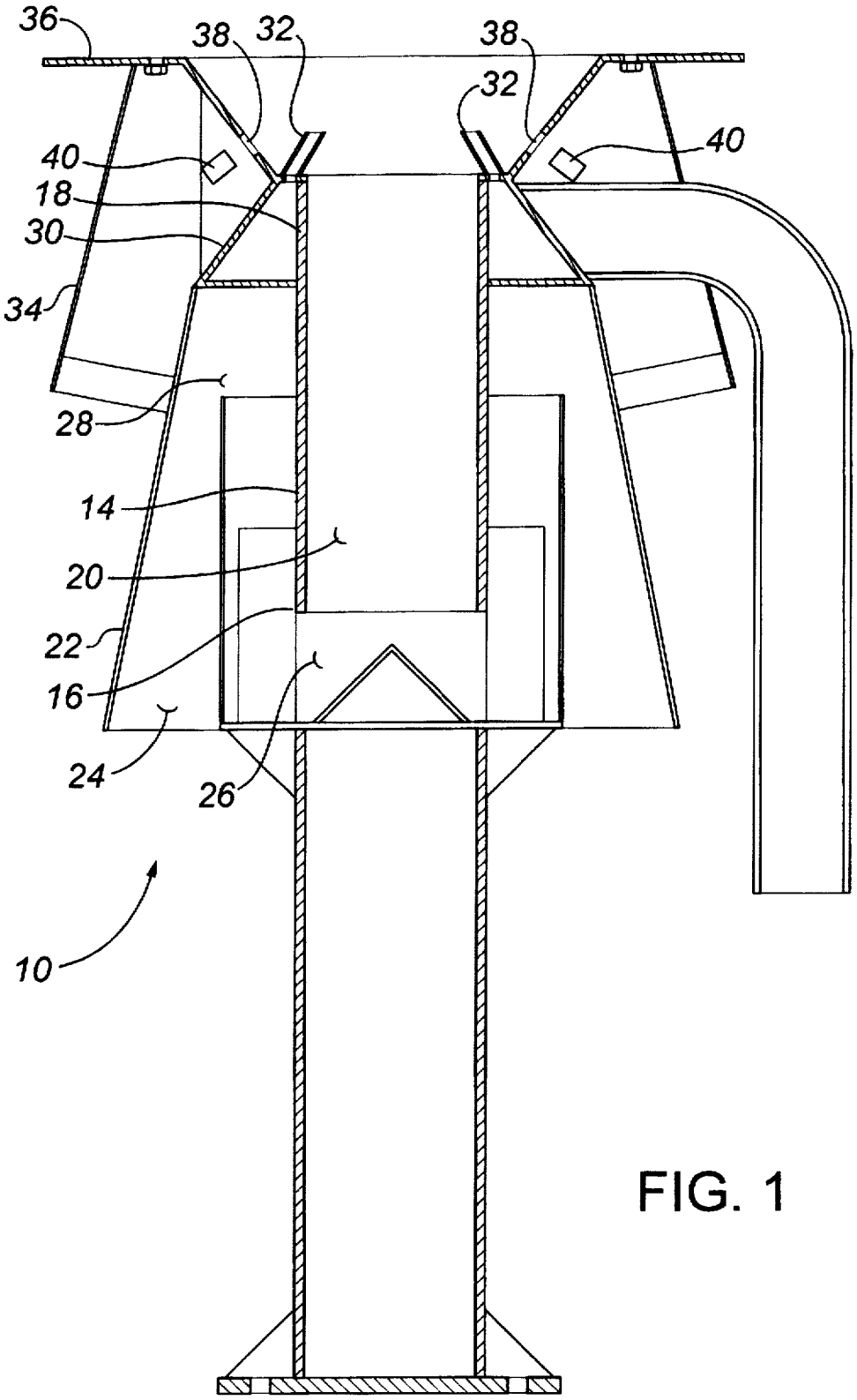
FIG. 1 is a side elevation view, in section, of a first embodiment of gas flare constructed in accordance with the teachings of the present invention.
Figure 2:
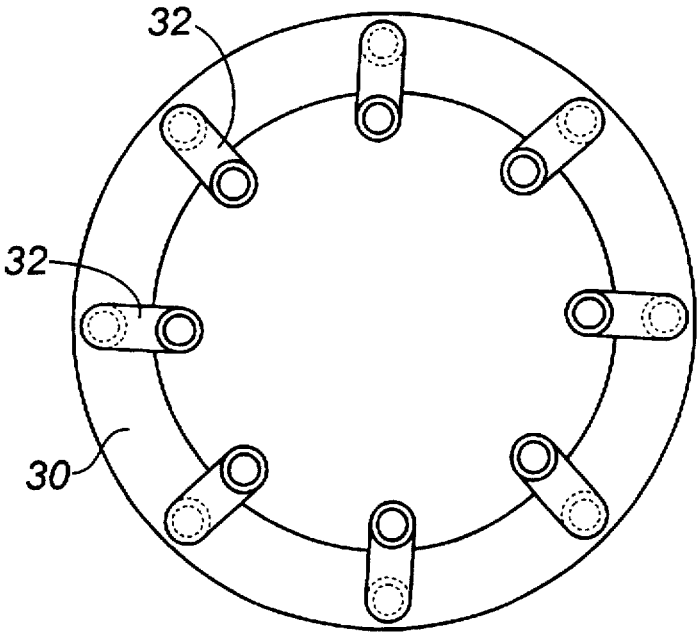
FIG. 2 is a detailed top plan view of the gas flare illustrated in FIG. 1, showing pressurized gas injection nozzle orientation.
Figure 3:
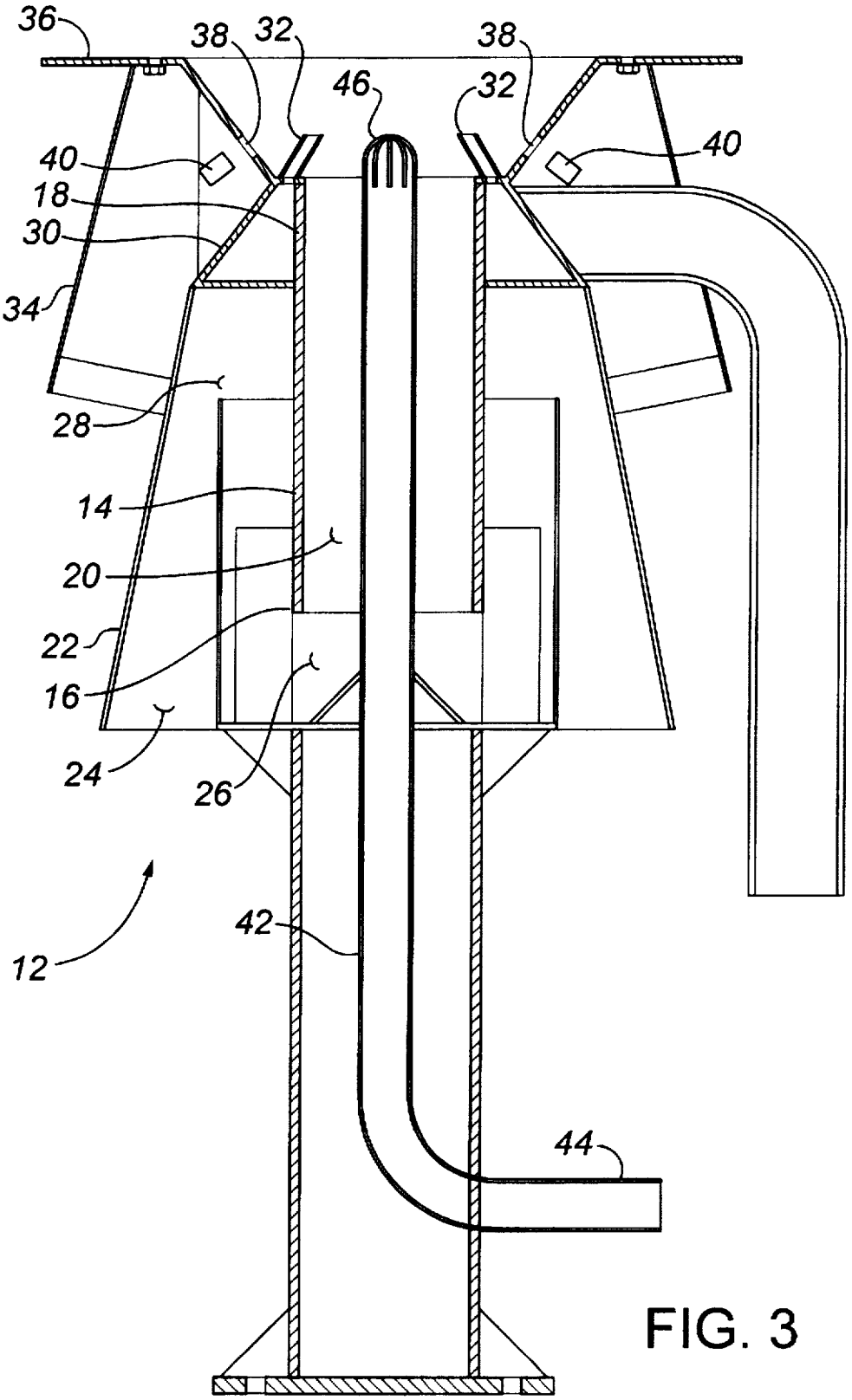
FIG. 3 is a side elevation view, in section, of a second embodiment of gas flare constructed in accordance with the teachings of the present invention.

The preferred embodiment, a gas flare will now be described with reference to FIGS. 1 through 3. Referring to FIG. 1, a first embodiment of the gas flare will generally be identified by reference numeral 10. Referring to FIG. 3, a second embodiment of the gas flare will generally be identified by reference numeral 12.

Referring to FIG. 1, first embodiment 10 of the gas flare includes a primary combustion air passage 14 having an inlet end 16, an outlet end 18 and an interior cavity 20 that extends between inlet end 16 and outlet end 18. A heat exchanger 22 is connected to inlet end 16 of primary combustion air passage 14. Heat exchanger 22 has an inlet end 24 through which combustion air enter, a connection end 26 which connects to inlet end 16 of primary combustion air passage 14 and a zig-zag passage 28 that extends between inlet end 24 connection end 26. Zig-zag passage 28 passes along an exterior surface of primary combustion air passage 14, whereby heat from primary combustion air passage 14 is transferred to the incoming combustion air. A pressurized gas injection ring 30 encircles outlet end 18 of primary combustion air passage 14. Pressurized gas injection ring 30 has a plurality of nozzles 32. Each of nozzles 32 is angled inwardly and upwardly, as illustrated in FIG. 1. Referring to FIG. 2, each of nozzles 32 is also angled a laterally by a few degrees. This angling is substantially consistent between nozzles. When gas passes under pressure through nozzles 32, a venturi effect is created with a generally helical circulation that both draws combustion air from primary combustion air passage 14 and intermixes the gas with the combustion air to form a combustible mixture. A combustion air circulation ring 34 encircles outlet end 18 of primary combustion air passage 18. The preferred configuration for combustion air circulation ring 34 is that of an inverted cone, with an upper flange 36 to which a stack (not shown) may be secured. Combustion air circulation ring 34 has a plurality of secondary combustion air passages 38. Combustion air is drawn through secondary combustion air passages 38, as required. Igniters 40 are positioned in the secondary combustion air passages 38 for igniting the combustible mixture.

Referring to FIG. 3, second embodiment 12 of the gas flare is virtually identical to that of the first embodiment and operates in substantially the same manner. For ease of reference and compactness of description, all common features have been given the identical reference numeral. Second embodiment 12 was developed for dry gas installations in which the gas to be flared is non-pressurized. In such installations, passing non-pressurized gas through pressurized gas injection ring 30 will not create the desired venturi effect. Instead, a non-pressurized gas passage 42 is concentrically positioned within interior cavity 20 of primary combustion air passage 14. Non-pressurized gas passage 42 has an inlet end 44 and an outlet end 46. Outlet end 46 is positioned adjacent to outlet end 18 of primary combustion air passage 14. In order to achieve the necessary venturi effect and an thorough intermixing of the gas with combustion air, pressurized make up gas, preferably taken off the back end of a gas treater, is fed into the pressurized gas injection ring.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A gas flare, comprising:

a primary combustion air passage having an inlet end, an outlet end and an interior cavity that extends between the inlet end and the outlet end;

a pressurized gas injection ring encircling the outlet end of the primary air passage, the pressurized gas injection ring having a plurality of nozzles, each of the nozzles being angled inwardly, upwardly and laterally in a substantially consistent fashion, thereby creating a venturi effect with a generally helical circulation that draws combustion air from the primary combustion air passage and intermixes the gas with the combustion air to form a combustion mixture;

a non-pressurized gas passage concentrically positioned within the interior cavity of the primary air passage, the non-pressurized gas passage having an inlet end and an outlet end, the outlet end of the non-pressurized gas passage being positioned adjacent to the outlet end of the primary combustion air passage and the gas injection ring;

a combustion air circulation ring encircling the pressurized gas injection ring and containing means for igniting the combustible mixture, the combustion air circulation ring having a plurality of passages whereby the means for igniting the combustible mixture is brought into communication with the combustible mixture; and means for attaching a stack to the combustion air circulation ring.

2. The gas flare as defined in claim 1, wherein a heat exchanger is connected to the inlet end of the primary air passage, thereby preheating combustion air.

3. A gas flare comprising:

a primary combustion air passage having an inlet end, an outlet end and an interior cavity that extends between the inlet end and the outlet end;

a heat exchanger is connected to the inlet end of the primary air passage, thereby preheating combustion air;

a non-pressurized gas passage concentrically positioned within the interior cavity of the primary air passage, the non-pressurized gas passage having an inlet end and an outlet end, and the outlet end of the non-pressurized gas passage positioned adjacent to the outlet end of the primary combustion air passage;

a pressurized gas injection ring encircling the outlet end of the primary combustion air passage, the pressurized gas injection ring having a plurality of nozzles, each of the nozzles being angled inwardly, upwardly and a few degrees laterally in a substantially consistent fashion, thereby creating a venturi effect with a generally helical circulation that draws combustion air from the primary combustion air passage and intermixes the gas with the combustion air to form a combustible mixture;

a combustion air circulation ring encircling the pressurized gas injection ring, the pressurized gas injection ring having a plurality of secondary combustion air passages from which combustion air is drawn;

means for igniting the combustible mixture positioned in the combustion air circulation ring, the means for igniting the combustible mixture being brought into communication with the combustible mixture through the secondary combustion air passages; and means for attaching a stack to the secondary combustion air circulation ring.

* * * * *